United States Patent [19]

Boloix

[11] Patent Number: 4,736,784

[45] Date of Patent: Apr. 12, 1988

[54] VERTICAL BLIND MECHANISM

[76] Inventor: Jose A. Boloix, 3211 NW. 16 Ter., Miami, Fla. 33125

[21] Appl. No.: 12,287

[22] Filed: Feb. 9, 1987

[51] Int. Cl.[4] ..... E06B 9/36

[52] U.S. Cl. ..... 160/168.1; 160/319; 160/166.1

[58] Field of Search ..... 160/176 R, 177, 168 R, 160/168 A, 166 A, 319, 320, 321

[56] References Cited

U.S. PATENT DOCUMENTS

| | | | |
|---|---|---|---|
| 3,190,346 | 6/1965 | Arena et al. | 160/172 |
| 3,280,891 | 10/1966 | Eldredge, Jr. . | |
| 3,366,160 | 1/1968 | Anderson | 160/323 R |
| 3,581,800 | 6/1971 | Nelson et al. | 160/323 R |
| 4,009,745 | 3/1977 | Erpenbeck | 160/323 R X |
| 4,381,029 | 4/1983 | Ford et al. | 160/172 |
| 4,381,812 | 5/1983 | Ford et al. | 160/172 |
| 4,425,956 | 1/1984 | Terlecke | 160/168 R |
| 4,449,564 | 5/1984 | Hansen et al. | 160/166 A |
| 4,628,981 | 12/1986 | Ciriaci et al. | 160/176 R |
| 4,657,060 | 4/1987 | Kaucic | 160/176 R X |

*Primary Examiner*—Ramon S. Britts
*Assistant Examiner*—David M. Purol
*Attorney, Agent, or Firm*—Jesus Sanchrlima

[57] ABSTRACT

A vertical blind mechanism using a traverse assembly with several louver carrying carriers that are interconnected with a pantograph and the louvers are rotated by the movement imparted by drive shaft disposed through the carriers. The drive wheel assembly includes two sprocket wheels, one of them freewheeling and the other one drives the shaft. Cords are routed through the carriers and connected to at least one of the carriers so that the movement to the others is transmitted through the pantograph. The sprockets have headed spring loaded terminations that are inserted through a bushing that is rigidly mounted to the drive assembly.

5 Claims, 2 Drawing Sheets

VERTICAL BLIND MECHANISM

BACKGROUND OF THE INVENTION

1. Field of the Invention

The present invention relates to vertical blind mechanism having vertically disposed louvers that move laterally and rotably about their vertical axes, and more particularly, to such mechanisms that include a plurality of carriers that are activated through cords and a drive shaft.

2. Description of the Related Art

Applicant believes that the closest reference corresponds to U.S. Pat. No. 3,280,891 issued to Richard J. Eldredge, Jr et al on Oct. 25, 1966. However, it differs from the present invention because Eldredge's device utilizes one drive wheel 93 to cause the louvers to rotate and cable runs 99*a* and 99*b* sandwich or run alongside of drive shaft 44, and through drive pulleys 97 and 98. In practice, drive wheel 93 and pulley 97 and 98 are contained within the same assembly in order to have a volumetrically efficient design, as shown in that patent FIG. 8. The present invention provides for two drive wheels, one of them being a dummy wheel, and the drive pulleys for the cable providing the lateral movement are positioned below and in between the downwardly projection of the wheel drives. Also, the assembly and cost of the present invention is simpler and lower since it does not require bearing housing 122, bearing 123 and snap ring 124 at the end of the drive shaft. Finally, the separation of the chain or cable over the two drive shaft is much greater than the separation provided by only one larger drive shaft that occupies a much larger space.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a vertical blind mechanism that includes a drive shaft assembly with cables and chains for lateral and rotation movement that are sufficiently separated to prevent their entanglement while at the same time are volumetrically efficient.

It is another object of this present invention to provide a such a mechanism that can be readily assembled with a minimum number of parts.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
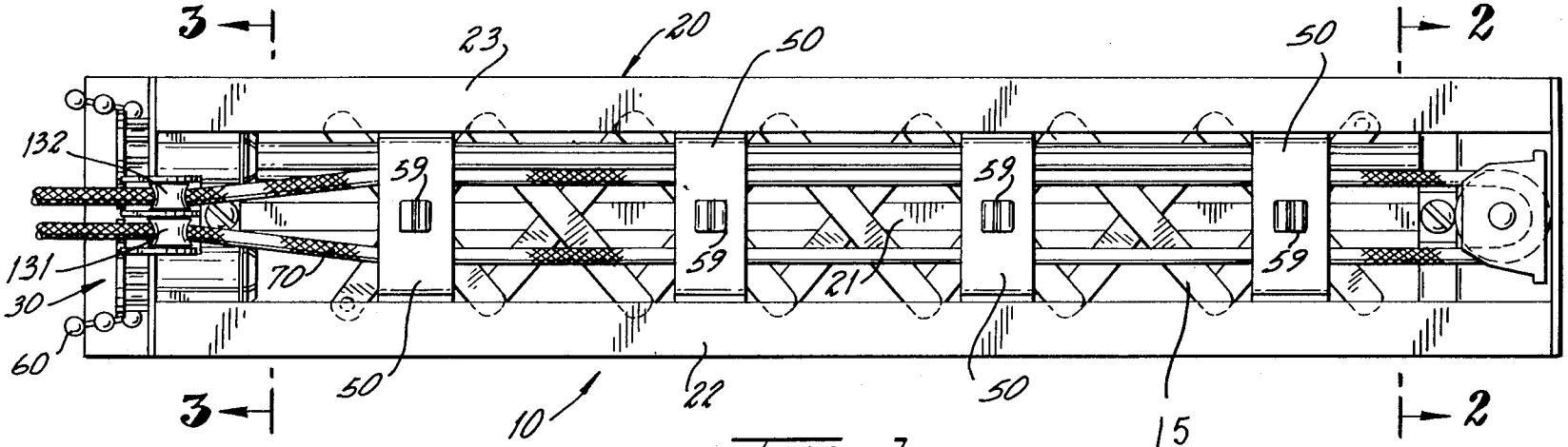
FIG. 1 represents a bottom view of the traversing mechanism.

Referring now to FIG. 1, it can be observed in FIG. 1 the present vertical blind mechanism 10 includes, basically, a traverse mechanism 20, a drive assembly 30 on one end of mechanism 20 and an idler pulley assembly 40 on the other end, a plurality of interconnected carriers 50, chain member 60 trained over drive assembly 30 and cord members 70 disposed through carriers 50 and adapted to move them in both directions.

Traverse mechanism 20 has substantially the shape of an inverted channel with inwardly projecting flanges 22 and 23. Supporting flanges 24 and 25, over which the carrier assemblies 50 will be slidably supported and guided, project inwardly and anchorage flanges 26 and 27 are located above flanges 24 and 25. The separation between the two pairs of flanges is enough to sandwich the body of idler pulley assembly 40, drive assembly 30 and wheels 52 of carrier 50.

Figure 3:
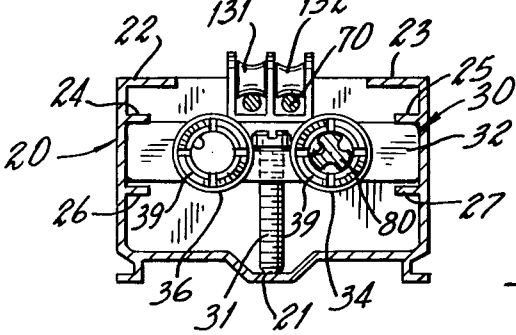
FIG. 3 illustrates a side view taken along line 3—3 in FIG. 1.
Figure 8:
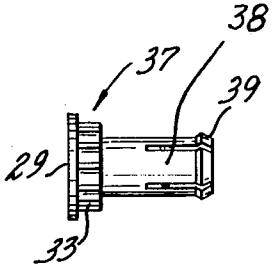
FIG. 8 shows the drive wheel used in one of the preferred embodiments.

As shown in FIG. 3, drive wheel assembly 30 is shown upside down from line 3—3 in FIG. 1. The body 32 of assembly 30 snuggly fits between inwardly projecting flanges pairs 24; 25 and 26; 27 and secured in place by a threaded bolt 31 that goes through body 32 and against longitudinal groove 21 in traverse mechanism 20. Bushing assembly 34 houses drive shaft 80 and bushing assembly 36 is freewheeling. Both bushing assemblies are rigidly mounted against plate 28. As it can be seen from FIG. 8, sprocket member 37 includes a spring loaded sleeve 38 with axial cuts and a built-in headed termination 39. When assembled, the installer only has to insert sleeve 38 through bushing assembly 34 to provide reliable means for transmitting the required rotational movement to drive shaft 80. Chain 60 is trained over sprocket wheel 33 and it is kept in place by cover 29 and plate 28. A pair of pulleys 131 and 132 have cord member 70 trained over them.

Figure 2:
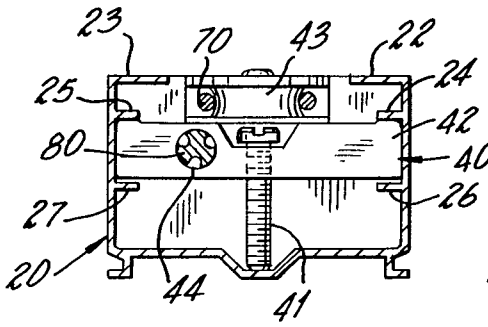
FIG. 2 shows a side view taken along line 2—2 in FIG. 1.
Figure 5:
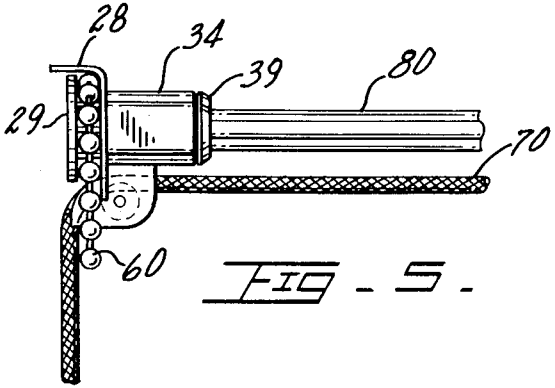
FIG. 5 is a side view of the drive assembly.
Figure 4:
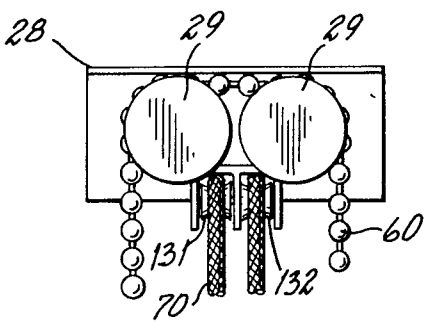
FIG. 4 is a representation of an end view of the traverse mechanism showing the drive assembly.

Idler pulley assembly 40, as shown in FIG. 2, also has a body 42 and it is similarly anchored relative to traverse assembly 20 by a bolt 41 that goes through it and exerts pressure against groove 21. The sprocket wheels 33 are sufficiently separated to prevent entanglement of the vertical runs of chain 60 with cord 70. The tangential vertical projection from the outer edges of wheels 30 should be sufficiently large to prevent entanglement and to allow a user to readily locate either chain 60 or cord 70. The friction of the upper side of body 42 against the lower side of anchorage flanges 26 and 27 keep assembly 40 securely in place. Opening 44 houses one end of shaft 80 allowing it to rotate freely therein. Idle pulley member 43 returns cord 70. Assembly 40 may be used on either end of traverse assembly 20 thereby facilitating the inventory logistics by requiring the stocking one part only.

Figure 7:
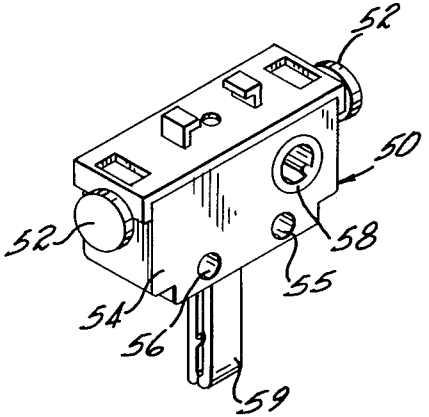
FIG. 7 illustrates a carrier used in one of the preferred embodiments, in perspective.
Figure 6:
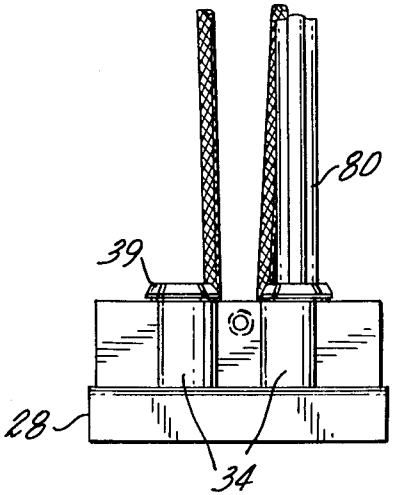
FIG. 6 shows a top view of the drive assembly.

Carrier assembly 50 is shown in perspective in FIG. 7 having a substantially elongated cubical body 54 with freewheeling wheels 52 mounted on its sides. Wheels 52 run over flanges 24 and 25. Through holes 55 and 56 are provided to allow cord 70 through. Through opening 58 allows drive shaft 80 through and an internal conventional gear mechanism (not shown) transmits the rotational movement of shaft 80 to stem 59. Stem 59 holds the upper end of the vertical louvers (not shown). A pantograph 15 is housed within traverse assembly 20 and interconnects carries 50.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A vertical venetian blind mechanism, comprising:

A. a horizontally disposed traverse means having the shape of an inverted channel with at least one pair of opposing inwardly extending flanges;

B. carrier means including a plurality of carriers arranged adjacent to each other and having two freewheeling wheels on each side rolling over said flanges, said carriers including one through opening having gear means and a louver stem actuated by said gear means;

C. pantograph means interconnecting said carriers;

D. a drive wheel assembly mounted at one end of said traverse means having anchorage means for rigidly securing said drive wheel assembly to said traverse means including two sprocket wheels having chain means trained over them and further including bushing means for each of said sprocket wheels and said drive wheel assembly having two pulleys mounted between and below said sprocket wheels and said sprocket wheels being coplanar and spaced apart with respect to each other a sufficient distance to separate the tangential vertical projection of the outer ends of said sprocket wheels from the vertical projection from said pulleys and said sprocket wheels further including built-in spring loaded sleeves having radially extending cuts, said sleeve including headed terminations that protrude beyond said bushings so that said sprocket wheels are kept in place;

E. a drive shaft engaged to one of said sprocket wheels and extending horizontally inside said traverse means and through said carriers' through opening so that the rotational movement imparted to said drive shaft is transmitted to said louver stem;

F. cord means connected to at least one of said carriers and trained over said pulleys;

G. idle pulley means for returning said cord means and being rigidly mounted on the other end of said traverse means.

2. The mechanism set forth in claim 1 wherein said drive wheel assembly includes a plate member separating said sprocket wheels from said bushings.

3. The mechanism set forth in claim 2 wherein said drive wheel assembly includes a cover member so that said chain means is kept trained over said sprocket wheels.

4. The mechanism set forth in claim 3 wherein said traverse means includes a longitudinal groove having an internal concavity and extending through the length of said transverse means and said drive wheel assembly and said idle pulley means includes bolt means for anchoring them in place.

5. The mechanism set forth in claim 4 wherein said drive wheel assembly is symmetric with respect to a plane cutting along its longitudinal center so that it can be used on either end of said traverse means.

* * * * *